US009016489B2

(12) United States Patent
McFarlane et al.

(10) Patent No.: US 9,016,489 B2
(45) Date of Patent: Apr. 28, 2015

(54) CIRCUMFERENTIAL REINFORCING GROOVE FOR CONTAINER FINISH

(75) Inventors: Ronald McFarlane, Sylvania, OH (US); Terry D. Patcheak, Ypsilanti, MI (US); James Stelzer, South Lyon, MI (US)

(73) Assignee: Amcor Limited, Hawthorn (AU)

( * ) Notice: Subject to any disclaimer, the term of this patent is extended or adjusted under 35 U.S.C. 154(b) by 536 days.

(21) Appl. No.: 13/167,102

(22) Filed: Jun. 23, 2011

(65) Prior Publication Data

US 2012/0000879 A1 Jan. 5, 2012

Related U.S. Application Data

(60) Provisional application No. 61/359,983, filed on Jun. 30, 2010.

(51) Int. Cl.
*B65D 41/34* (2006.01)
*B65D 1/02* (2006.01)

(52) U.S. Cl.
CPC ..... *B65D 1/0246* (2013.01); *Y10S 215/901* (2013.01)

(58) Field of Classification Search
USPC ..... 215/40–47, 209, 216, 217, 221, 215/254–256, 273, 901; 220/276, 315
See application file for complete search history.

(56) References Cited

U.S. PATENT DOCUMENTS 3,716,162 A * 2/1973 Botkin ..... 215/316
3,744,655 A * 7/1973 Nixdorff, Jr. ..... 215/216
3,841,512 A * 10/1974 Botkin ..... 215/365
3,989,152 A * 11/1976 Julian ..... 215/216
4,036,385 A * 7/1977 Morris ..... 215/209
4,071,156 A * 1/1978 Lowe ..... 215/224
4,099,639 A * 7/1978 Boxer et al. ..... 215/209
4,103,797 A * 8/1978 Morris ..... 215/209
4,131,212 A * 12/1978 Rumball ..... 215/252
4,153,174 A * 5/1979 Keeler ..... 215/252
4,326,639 A * 4/1982 Stahl et al. ..... 215/252
4,337,870 A * 7/1982 Keeler ..... 215/252
4,436,212 A * 3/1984 Alejandro Llera ..... 215/252
4,512,485 A * 4/1985 Agbay et al. ..... 215/225
4,524,876 A * 6/1985 Kusz ..... 215/224
4,573,598 A * 3/1986 Perry ..... 215/204
4,573,599 A * 3/1986 Fillmore ..... 215/225
4,687,114 A * 8/1987 Crisci ..... 215/256
4,752,014 A * 6/1988 House et al. ..... 215/216
4,771,904 A * 9/1988 Perne et al. ..... 215/252
4,815,620 A * 3/1989 Bullock, III ..... 215/256
4,922,684 A * 5/1990 Nelson ..... 53/314
4,948,002 A * 8/1990 Thornock et al. ..... 215/221
4,993,570 A * 2/1991 Julian et al. ..... 215/252
5,027,964 A * 7/1991 Banich, Sr. ..... 215/252
5,097,974 A * 3/1992 Rozenberg ..... 215/225
5,143,235 A * 9/1992 Repp ..... 215/256
5,165,559 A * 11/1992 Kusz ..... 215/216
5,413,233 A * 5/1995 Hall ..... 215/209

(Continued)

*Primary Examiner* — Anthony Stashick
*Assistant Examiner* — Ned A Walker
(74) *Attorney, Agent, or Firm* — Harness, Dickey & Pierce, P.L.C.

(57) ABSTRACT

A container including a finish, a sidewall portion, a base portion, and an inwardly directed rib member. The finish has a thread portion and an opening formed by the finish. The sidewall portion extends from the finish. The base portion extends from the sidewall portion and encloses the sidewall portion to form a volume for retaining a commodity. The inwardly directed rib member is disposed circumferentially about the finish.

14 Claims, 3 Drawing Sheets

(56) References Cited

U.S. PATENT DOCUMENTS

| | | | | | |
|---|---|---|---|---|---|
| 5,423,441 | A * | 6/1995 | Conti | 215/225 |
| 5,544,768 | A * | 8/1996 | Gargione | 215/209 |
| 5,586,671 | A * | 12/1996 | Thomas et al. | 215/209 |
| D380,158 | S * | 6/1997 | Olivares et al. | D9/541 |
| 5,671,853 | A * | 9/1997 | Herr | 215/216 |
| 5,706,963 | A * | 1/1998 | Gargione | 215/219 |
| 5,711,442 | A * | 1/1998 | Kusz | 215/209 |
| 5,740,933 | A * | 4/1998 | Conti et al. | 215/256 |
| 5,899,348 | A * | 5/1999 | Konefal et al. | 215/209 |
| 5,927,527 | A * | 7/1999 | Montgomery et al. | 215/219 |
| D413,265 | S * | 8/1999 | Hestehave et al. | D9/541 |
| 5,938,054 | A * | 8/1999 | Loader | 215/206 |
| 6,003,701 | A * | 12/1999 | Hidding et al. | 215/252 |
| 6,039,195 | A * | 3/2000 | Konefal et al. | 215/209 |
| 6,039,196 | A * | 3/2000 | Ekkert et al. | 215/216 |
| 6,076,689 | A * | 6/2000 | Vassallo | 215/209 |
| 6,079,579 | A * | 6/2000 | De Cuyper | 215/41 |
| 6,105,800 | A * | 8/2000 | Czesak | 215/42 |
| 6,168,035 | B1 * | 1/2001 | McLelland | 215/216 |
| 6,327,770 | B1 * | 12/2001 | Konefal et al. | 29/450 |
| 6,508,373 | B1 * | 1/2003 | Robinson | 215/209 |
| 6,814,259 | B1 * | 11/2004 | Foster et al. | 222/153.09 |
| 7,080,747 | B2 * | 7/2006 | Lane et al. | 215/381 |
| 7,207,451 | B2 * | 4/2007 | Taylor et al. | 215/42 |
| 7,520,399 | B2 * | 4/2009 | Lane et al. | 215/10 |
| 7,527,160 | B2 * | 5/2009 | Shingle | 215/228 |
| 7,628,283 | B2 * | 12/2009 | Shingle | 215/209 |
| 7,694,835 | B1 * | 4/2010 | Montgomery | 215/329 |
| 8,308,002 | B2 * | 11/2012 | Penny | 215/44 |
| 2005/0103741 | A1 * | 5/2005 | Shingle | 215/228 |
| 2005/0263477 | A1 * | 12/2005 | Konefal et al. | 215/228 |
| 2006/0070970 | A1 * | 4/2006 | Shingle | 215/220 |
| 2006/0070973 | A1 * | 4/2006 | Shingle | 215/329 |
| 2006/0213861 | A1 * | 9/2006 | Konefal et al. | 215/222 |
| 2006/0249474 | A1 * | 11/2006 | Sawyer et al. | 215/256 |
| 2006/0255004 | A1 * | 11/2006 | Shingle et al. | 215/332 |
| 2007/0012645 | A1 * | 1/2007 | Gnepper et al. | 215/222 |
| 2007/0023380 | A1 * | 2/2007 | Shingle et al. | 215/217 |
| 2007/0045216 | A1 | 3/2007 | Gami et al. | |
| 2008/0169263 | A1 * | 7/2008 | Shingle | 215/252 |
| 2009/0283495 | A1 * | 11/2009 | Lane et al. | 215/383 |

* cited by examiner

CIRCUMFERENTIAL REINFORCING GROOVE FOR CONTAINER FINISH

CROSS-REFERENCE TO RELATED APPLICATIONS

This application claims the benefit of U.S. Provisional Application No. 61/359,983, filed on Jun. 30, 2010. The entire disclosure of the above application is incorporated herein by reference.

FIELD

This disclosure generally relates to containers for retaining a commodity, such as a solid or liquid commodity. More specifically, this disclosure relates to a container having optimized horizontal ribs disposed about a finish of the container.

BACKGROUND AND SUMMARY

This section provides background information related to the present disclosure which is not necessarily prior art. This section also provides a general summary of the disclosure, and is not a comprehensive disclosure of its full scope or all of its features.

As a result of environmental and other concerns, plastic containers, more specifically polyester and even more specifically polyethylene terephthalate (PET) containers are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where ρ is the density of the PET material; ρa is the density of pure amorphous PET material (1.333 g/cc); and ρc is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching an injection molded PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately two (2) to five (5) seconds. Manufacturers of PET juice bottles, which must be hot-filled at approximately 185° F. (85° C.), currently use heat setting to produce PET bottles having an overall crystallinity in the range of approximately 25%-35%.

Unfortunately, with some applications particularly those relating to high temperature food products (i.e. applesauce, pasta sauces, salsa, etc.) where the product is packaged and/or dispensed at high temperatures, it is often desirable to package these products in containers having wide mouth finish openings to permit convenient access to the product using a spoon or other cooking implement. These wide mouth finish openings, typically regarded as those greater than about 63 mm in diameter, must withstand contact with product temperatures up to about 205 deg F. and maintain functional performance such as seal integrity and recommended closure removal torque between the neck finish and closure cap.

In conventional applications, neck finishes were injected and crystallized to meet the required finish integrity and crystallinity at elevated temperatures. This approach was less economical due to low injection cavitation and the need for secondary processing to crystallize the neck finish after the preform part was produced.

However, today, technology has advanced that allows the neck finish to be blow molded, if sufficient structural integrity can be achieved in these wide mouth applications. That is, the goal would be to blow mold a container having a neck finish that achieves a crystallinity level greater than about 25%.

Conventionally, use of a closure cap on the neck finish, in high temperature food product applications with crystallinity levels greater than about 25%, causes inwardly-directed forces to the finish. When the neck finish comes in contact with the hot filled product thereafter, the neck finish becomes less rigid. Additionally, post pasteurization (where hot water spray, usually at or slightly above the product fill temperature, is applied on the container over a specified time (depending on customer requirement)) is requiring the neck finish to hold it shaped over a long period prior to post cooling. The combination of reduced rigidity, heat time duration, and the inward force from the closure, results in finish movement which then reduces the closure removal torque and possibly the seal integrity.

Therefore, although to date, preform design, mold temperature, and processing have produced blown neck finishes with an average crystallinity above 25%, it appears that the neck finish continues to experience disadvantageous movement resulting in low removal torque.

For at least this reason, the principles of the present teachings provide an improved neck finish for use in a container that provides improved structural integrity, especially in application of wide mouth container openings having average crystallinity above 25% and high temperature exposure. It should be appreciated that the principles of the present teachings have utility in a wide range of applications and uses, and thus the present disclosure should not be regarded as limited to only wide mouth opening containers, containers having an average crystallinity above 25%, or containers having high temperature exposure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
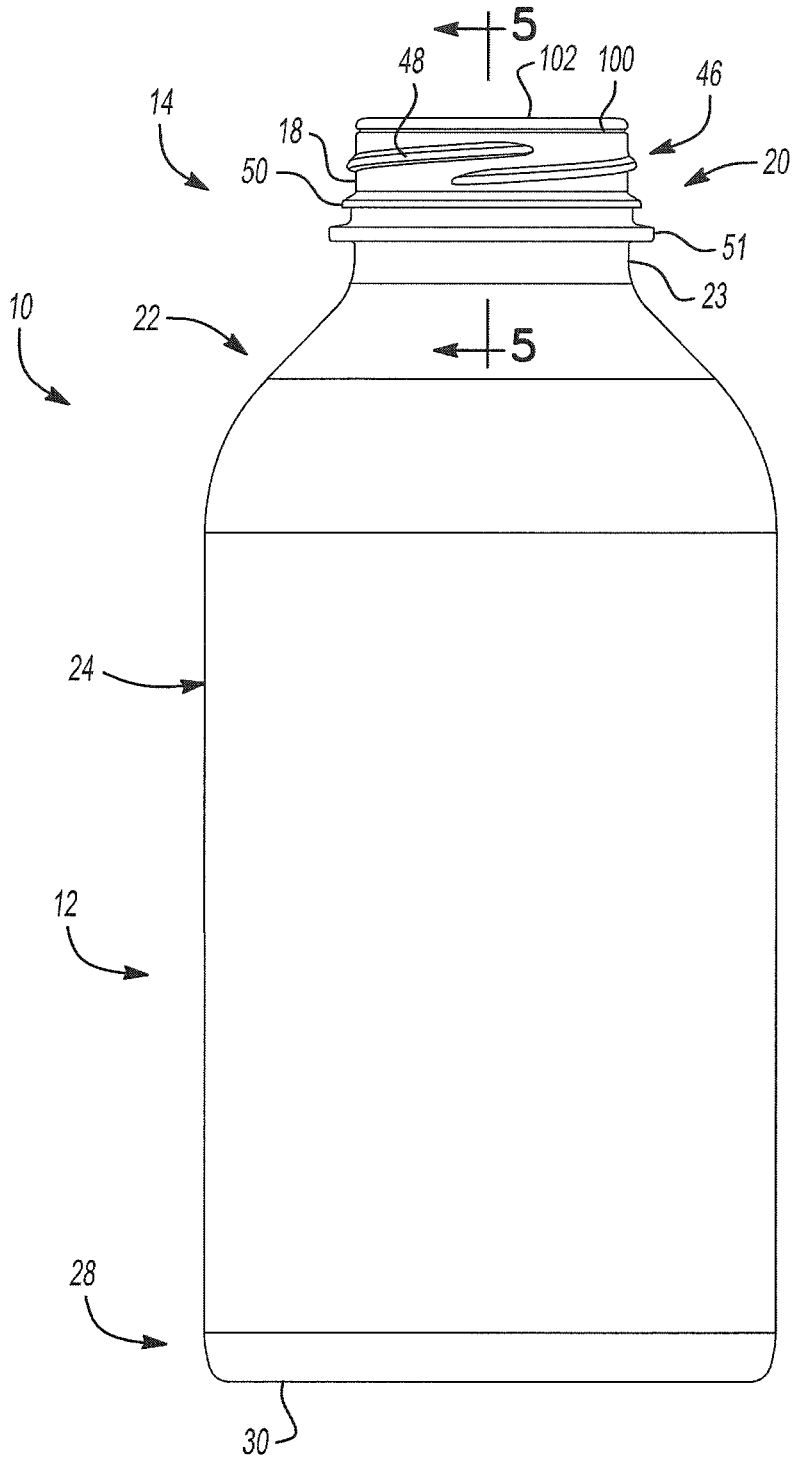
FIG. 1 is a front view of an exemplary container incorporating the features of the present teachings.
Figure 2:
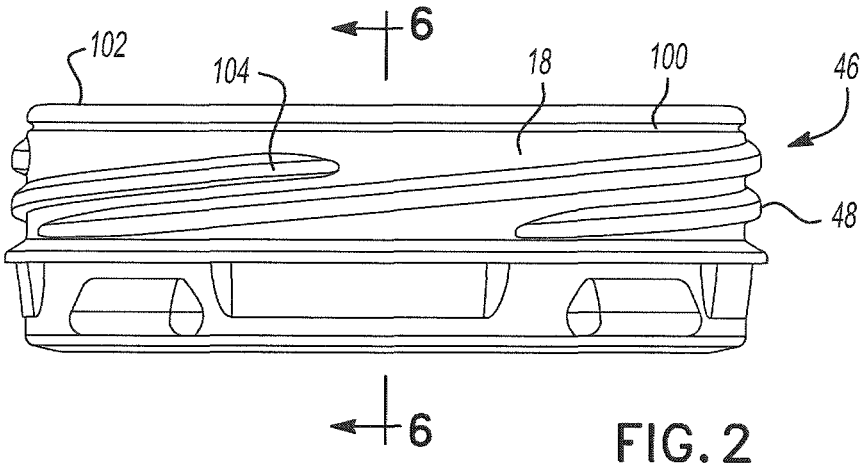
FIG. 2 is an enlarged side view of a finish of an exemplary container incorporating the features of the present teachings.
Figure 3:
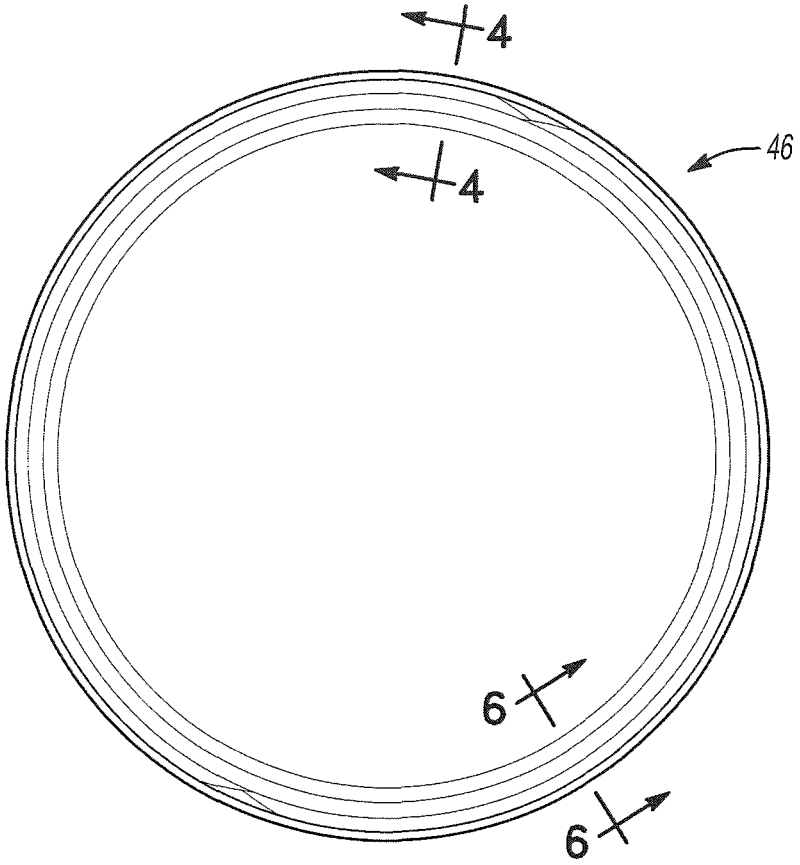
FIG. 3 is a plan view of the finish of an exemplary container incorporating the features of the present teachings.
Figure 4:
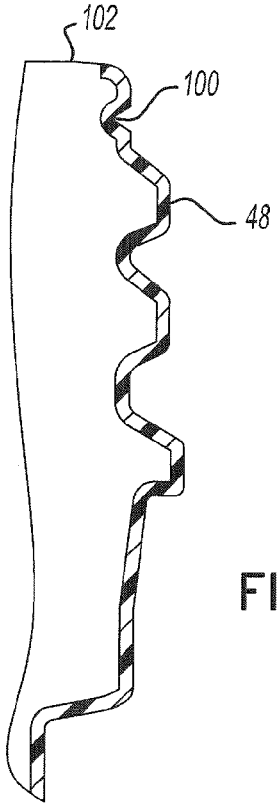
FIG. 4 is a cross-sectional view of the finish of an exemplary container incorporating the features of the present teachings taken along line 4-4 of FIG. 3.
Figure 5:
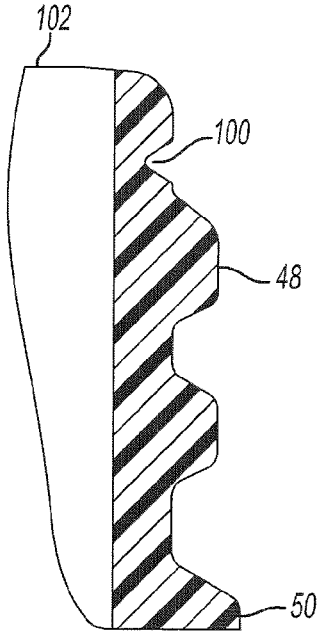
Figure 6:
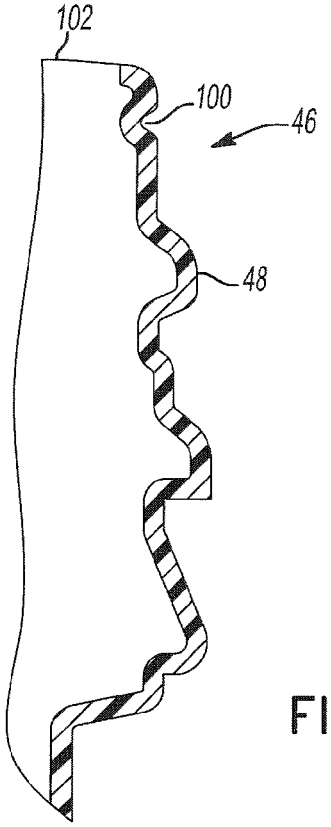

FIG. 5 is a cross-sectional view of the finish of an exemplary container incorporating the features of the present teachings taken along line 5-5 of FIG. 1; and FIG. 6 is a cross-sectional view of the finish of an exemplary container incorporating the features of the present teachings taken along line 6-6 of FIGS. 2 and 3;

Corresponding reference numerals indicate corresponding parts throughout the several views of the drawings.

DETAILED DESCRIPTION

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

This disclosure provides for a container being made of PET and incorporating a reinforcement rib disposed about the neck finish of the container that is particularly useful in applications of wide mouth container openings having average crystallinity above 25% and high temperature exposure, although not limited thereto.

It should be appreciated that the size and specific configuration of the container may not be particularly limiting and, thus, the principles of the present teachings can be applicable to a wide variety of PET container shapes. Therefore, it should be recognized that variations can exist in the present embodiments. That is, it should be appreciated that the teachings of the present disclosure can be used in a wide variety of containers, including reusable/disposable packages including resealable plastic bags (e.g., ZipLock® bags), resealable containers (e.g., TupperWare® containers), dried food containers (e.g., dried milk), drug containers, chemical packaging, squeezable containers, recyclable containers, and the like.

Accordingly, the present teachings provide a plastic, e.g. polyethylene terephthalate (PET), container generally indicated at 10. The exemplary container 10 can be substantially elongated when viewed from a side and rectangular when viewed from above. Those of ordinary skill in the art would appreciate that the following teachings of the present disclosure are applicable to other containers, such as rectangular, triangular, pentagonal, hexagonal, octagonal, polygonal, or square shaped containers, which may have different dimensions and volume capacities. It is also contemplated that other modifications can be made depending on the specific application and environmental requirements.

In some embodiments, container 10 has been designed to retain a commodity. The commodity may be in any form such as a solid or semi-solid product. In one example, a commodity may be introduced into the container during a thermal process, typically a hot-fill process. For hot-fill bottling applications, bottlers generally fill the container 10 with a product at an elevated temperature between approximately 155° F. to 205° F. (approximately 68° C. to 96° C.) and seal the container 10 with a closure before cooling. In addition, the plastic container 10 may be suitable for other high-temperature pasteurization or retort filling processes or other thermal processes as well. In another example, the commodity may be introduced into the container under ambient temperatures.

As shown in FIG. 1, the exemplary plastic container 10 according to the present teachings defines a body 12, and includes an upper portion 14 having a cylindrical sidewall 18 forming a finish 20. Integrally formed with the finish 20 and extending downward therefrom is a shoulder portion 22. The shoulder portion 22 merges into and provides a transition between the finish 20 and a sidewall portion 24. The sidewall portion 24 extends downward from the shoulder portion 22 to a base portion 28 having a base 30. In some embodiments, sidewall portion 24 can extend down and nearly abut base 30, thereby minimizing the overall area of base portion 28 such that there is not a discernable base portion 28 when exemplary container 10 is uprightly-placed on a surface.

The exemplary container 10 may also have a neck 23. The neck 23 may have an extremely short height, that is, becoming a short extension from the finish 20, or an elongated height, extending between the finish 20 and the shoulder portion 22. The upper portion 14 can define an opening for filling and dispensing of a commodity stored therein. Although the container is shown as a wide mouth container, it should be appreciated that containers having different shapes, such as sidewalls and openings, can be made according to the principles of the present teachings.

The finish 20 of the exemplary plastic container 10 may include a threaded region 46 having threads 48, a lower sealing ridge 50, and a support ring 51. The threaded region provides a means for attachment of a similarly threaded closure or cap (not shown). Alternatives may include other suitable devices that engage the finish 20 of the exemplary plastic container 10, such as a press-fit or snap-fit cap for example. Accordingly, the closure or cap engages the finish 20 to preferably provide a hermetical seal of the exemplary plastic container 10. The closure or cap is preferably of a plastic or metal material conventional to the closure industry and suitable for subsequent thermal processing.

According to the principles of the present teachings, finish 20 can comprises a circumferential rib or groove 100 extending about cylindrical sidewall 18 defining a continuous inwardly directed groove circumscribing cylindrical sidewall 18 to provide improve structural integrity and/or reinforcement within finish 20, without being positioned at a weakened area. Rib 100 can be generally horizontally disposed generally parallel to base 30. In some embodiments, rib 100 can be position between a top edge 102 of finish 20 and the start of threads 48, specifically illustrated in FIG. 2 at numeral 104. In some embodiments, rib 100 can define a recessed groove having radiused corners that is visible from an exterior of the container 10. Moreover, in some embodiments, an interior surface of finish 20, inboard of rib 100, can define a generally flat surface—that is, a surface that is generally consistent and unobstructed, such that rib 100 is indiscernible when viewed from an interior of the container 10.

It has been found that rib 100 provided improved structural integrity by increasing the hoop strength of finish 20 of container 10, thereby resisting deflection and/or deformation caused by heat time duration and the inward force from the closure, which can otherwise result in finish movement that reduces the closure removal torque and possibly leads to compromised seal integrity. It should be noted that the positioning of rib 100 between the top edge 102 of finish 20 and the start of threads 48 has been found to provide the desired increase in hoop strength without weakening the overall structure.

By way of non-limiting example, it has been found that a rib 100 having a depth of about 0.51 mm, an internal radius of about 0.35 mm, and an internal angle of about 60 degrees provides the benefits set forth in the present application. However, it should be understood that broader ranges of dimensions are possible, including rib 100 having a depth of about 0.25 mm-1 mm (preferably about 0.51 mm), a radius of about 0.15 mm-0.50 mm (preferably about 0.35 mm), and an internal angle of about 30°-90° (preferably about 60°).

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A plastic bottle comprising:
- a body comprising:
  - a shoulder;
  - a cylindrical sidewall;
  - a closed base extending inwardly from said sidewall; and,
  - a volume for retaining a commodity, said shoulder, said cylindrical sidewall, and said closed base collectively form an interior defining said volume; and,
- a neck comprising:
  - a support ring;
  - a continuous annular wall extending upwardly from said shoulder to said support ring;
  - an annular sealing ridge axially spaced from said support ring;
  - a circumferential sidewall comprising:
    - a rim defining an open top in a first plane;
    - an annular groove formed within an outer surface of said circumferential sidewall and spaced from said rim, said annular groove disposed in a second plane extending generally parallel to said first plane; and,
    - a helical thread protruding outwardly from said outer surface, said helical thread having an uppermost portion spaced from said annular groove and a lowermost portion spaced from said annular sealing ridge, and said helical thread capable of receiving a removable threaded closure.

2. The plastic bottle according to claim 1, wherein said second plane is generally parallel to a third plane corresponding to the closed base.

3. The plastic bottle according to claim 1 wherein said neck defines a generally unobstructed continuous interior surface opposite said annular groove.

4. The plastic bottle according to claim 1, wherein said annular groove comprises a depth in the range of about 0.25 mm to about 1 mm.

5. The plastic bottle according to claim 1, wherein said annular groove comprises a depth of 0.51 mm.

6. The plastic bottle according to claim 1, wherein said annular groove comprises a radius in the range of about 0.15 mm to about 0.50 mm.

7. The plastic bottle according to claim 1, wherein said annular groove comprises a radius of 0.35 mm.

8. The plastic bottle according to claim 1, wherein said annular groove comprises an internal angle in the range of about 30° to about 90°.

9. The plastic bottle according to claim 1, wherein said annular groove comprises an internal angle of about 60°.

10. A container comprising:

a closed base; and, a sidewall having:

an upper portion; and, a cylindrical lower portion upwardly extending from said closed base to define a cavity for retaining a commodity;

a neck comprising:

a rim having:

an inner upper edge defining an open top for receiving and dispensing said commodity;

a rounded outer upper edge defining a first radial thickness;

an annular lower portion;

a circumferential interior surface axially extending between said inner upper edge and said upper portion of said sidewall, said circumferential interior surface being continuous and unobstructed throughout;

a cylindrical wall having a helical thread formed on an exterior surface, said helical thread defining a second radial thickness, wherein said second radial thickness is greater than said first radial thickness of said rounded outer upper edge;

a lower sealing ring axially spaced below said helical thread and extending outwardly from said exterior surface, said sealing ring being sealingly engagable with a closure for closing said open top to store said commodity in said cavity;

a circumferential groove formed on said exterior surface and separating said annular lower portion of said rim from an upper end of said helical thread.

11. The container according to claim 10, wherein said circumferential groove defines an upper radial axis generally horizontally disposed generally parallel to a lower radial axis defined by the base portion, and said circumferential groove is confined to a first plane extending generally parallel to a second plane defined by open top.

12. The container according to claim 10, further comprising a support ring extending outwardly from said exterior surface of said neck, said support ring being disposed axially below said helical thread such that said helical thread is disposed between said support ring and said circumferential groove.

13. The container of claim 10, wherein a second planar vertical portion of the exterior surface extends away from the circumferential groove and away from the closed base, and between the second planar vertical portion and said rim, the exterior surface curves radially inward towards the open top.

14. A container comprising:

a circumferential finish surrounding a central vertical axis and having a thread portion and an opening formed along a top edge of the finish in an opening plane transverse to said central vertical axis, said thread portion being formed to threadedly engage a closure member, said finish having an exterior surface with a variable diameter and a generally unobstructed interior surface extending continuously along said central vertical axis, said thread portion being disposed on said exterior surface;

a neck extending downwardly from said finish along said central axis;

a sidewall portion extending from said neck;

a base portion extending inwardly from said sidewall portion and enclosing a lower end of said sidewall portion to form a volume for retaining a commodity, said base portion confined to a base plane transverse to said central axis;

a circumferential groove formed within said exterior surface of said finish between said top edge and said thread portion, the circumferential groove having a sloped upper wall portion and a sloped lower wall portion joined at an apex confined to a groove plane extending generally parallel to the base plane;

a first annular portion of the exterior surface extends along said central vertical axis between the circumferential groove and a start of the thread portion;

a second annular portion of the exterior surface extends upwardly along said central vertical axis from said circumferential groove toward said top edge;

a curved annular portion of the exterior surface extends axially between the second planar annular portion and said top edge of the finish and curves radially inward towards the opening;

a support ring extending from at least one of said finish, said neck, and said sidewall portion, said support ring being disposed below said thread portion such that said thread portion is disposed between said support ring and said circumferential groove; and a sealing ridge extending from at least one of said finish and said neck, said sealing ridge being sealingly engagable with the closure member and disposed below said circumferential groove and said thread portion such that said sealing ridge is positioned between said thread portion and said support ring, said sealing ridge extending radially outward further than said thread portion and said top edge extend radially outward.

* * * * *